US005281658A

United States Patent [19]

Ona et al.

[11] Patent Number: 5,281,658

[45] Date of Patent: Jan. 25, 1994

[54] FIBER TREATMENT AGENT COMPOSITION

[75] Inventors: Isao Ona; Masaru Ozaki, both of Chiba, Japan

[73] Assignee: Dow Corning Toray Silicone Co., Ltd., Tokyo, Japan

[21] Appl. No.: 445,511

[22] Filed: Dec. 4, 1989

[30] Foreign Application Priority Data

Dec. 19, 1988 [JP] Japan ..... 63-320213

[51] Int. Cl.[5] ..... C08L 83/08

[52] U.S. Cl. ..... 524/838; 524/863; 528/26; 106/287.11

[58] Field of Search ..... 106/287.11; 528/26; 556/419, 420; 524/838, 863

[56] References Cited

U.S. PATENT DOCUMENTS 4,247,592 1/1981 Kalinowski ..... 428/266
4,283,519 8/1981 Pines et al. ..... 528/26
4,311,626 1/1982 Ona et al. ..... 260/29.2
4,359,545 11/1982 Ona et al. ..... 524/262
4,366,001 12/1982 Ona et al. ..... 106/287.11
4,427,815 1/1984 Ona et al. ..... 524/315
4,785,067 11/1988 Brumbill ..... 528/26
4,973,620 11/1990 Ona et al. ..... 524/292

*Primary Examiner*—Ralph H. Dean
*Attorney, Agent, or Firm*—George A. Grindahl; Robert L. McKellar

[57] ABSTRACT

A composition comprising the reaction product of an aminohydrocarbyl-substituted polydiorganosiloxane and a carboxy-substituted ethylene glycol is an effective composition for treating fibrous materials to enhance the water absorbency, perspiration absorbency, flexibility, lubricancy, and resilient elasticity of the material without inducing the yellowish coloration of said fiber material.

The fiber treatment agent composition can be easily emulsified, and the stability of the resulting emulsion is excellent.

10 Claims, No Drawings

FIBER TREATMENT AGENT COMPOSITION

BACKGROUND OF THE INVENTION

The present invention concerns an organopolysiloxane fiber treatment agent composition.

To improve the lubricity of conventional fiber materials, e.g. natural fibers such as cotton, hemp, silk, wool, angora, mohair, etc., regenerated fibers such as rayon, Bemberg, etc.), semisynthetic fibers such as acetate, etc., and synthetic fibers such as polyester, polyacrylonitrile, polyvinyl chloride, vinylon, polyethylene, polypropylene, polyamide, Spandex, etc., a fiber treatment agent which contains an organopolysiloxane which contains a group represented by the following formula:

$$-CH_2CH_2CH_2NHCH_2CH_2NH_2$$

as a main agent has been used. See Japanese Kokoku Patent No. Sho 57(1982)-43673.

If a fiber is treated with said organopolysiloxane which contains a group represented by $-CH_2CH_2CH_2NHCH_2CH_2NH_2$ however, the water repellency is too high, and if the resulting fiber is used as the constituent material of underwear, towels, etc., the perspiration absorbency and water absorbency are extremely inferior. Moreover, said fiber is spontaneously oxidized over time, and then, yellowish coloration is inevitable.

BRIEF SUMMARY OF THE INVENTION

The foremost objective of the present invention, which has been proposed to eliminate the aforementioned problems, is to provide a fiber treatment agent which is capable of attaining excellent water absorbency, perspiration absorbency, and lubricity without inducing the yellowish coloration of a fiber material.

The aforementioned objective can be attained using a fiber treatment agent composition which comprises (A) an organopolysiloxane which is represented by the formula $$Ar_2SiO(R_2SiO)_p(\underset{\underset{R^1(NHCH_2CH_2)_aNH_2}{|}}{R}SiO)_qSiR_2A$$

in which R is a monovalent hydrocarbon group; A is a group selected from the group consisting of R groups, the hydroxyl group, alkoxy groups containing 1-3 carbon atoms, and groups represented by $-R^1(NHCH_2CH_2)_aNH_2$; $R^1$ is a divalent hydrocarbon group; the subscript a is a number of 0 to 10; the subscripts p and q are 0 or numbers of 1 or above; p+q has a value of from 10 to 2,000 there being at least one intramolecular group represented by the following formula $-R^1(NHCH_2CH_2)_aNH_2$; and (B) a compound represented by the formula $R^2(C_2H_4O)_bR^3COOH$ in which $R^2$ is a group selected from the group consisting of alkoxy groups containing 1-3 carbon atoms and groups represented by $-OR^3COOH$; the subscript b is a number of 1 or above; $R^3$ is a divalent hydrocarbon group; the amount of (B) being from 0.05 to 5.0 mol with respect to 1 mol of primary and secondary amino groups of component (A).

DETAILED DESCRIPTION OF THE INVENTION

The compound which is used as component (A) is an organopolysiloxane which is represented by the following general formula.

$$Ar_2SiO(R_2SiO)_p(\underset{\underset{R^1(NHCH_2CH_2)_aNH_2}{|}}{R}SiO)_qSiR_2A$$

In this formula R is a monovalent hydrocarbon group; A is a group selected from among groups corresponding to R, the hydroxyl group, alkoxy groups containing 1-3 carbon atoms, and groups represented by $-R^1(NHCH_2CH_2)_aNH_2$; $R^1$ is a divalent hydrocarbon group; a is a number of 0-10; p and q are 0 or numbers of 1 or above; p+q is 10-2,000 and which contains at least one group in molecule represented by the following formula $-R^1(NHCH_2CH_2)_aNH_2$.

R is a monovalent hydrocarbon group. Concrete examples of such groups include alkyl groups, e.g. methyl, ethyl, propyl, butyl, etc.; aryl groups, e.g. phenyl, xenyl, naphthyl, etc.; alkaryl groups, e.g. tolyl, xylyl, etc.; aralkyl groups, e.g. 2-phenylethyl, 2-phenylpropyl, etc.; alkenyl groups, e.g. vinyl, propenyl, butadienyl, etc.; halogen-substituted alkyl groups, e.g. 3,3,3-trifluoropropyl group, etc.; and cycloalkenyl groups, e.g. cyclohexyl group, etc. In particular, alkyl groups, alkenyl groups, and aryl groups are especially desirable. The methyl group is ideal. The individual groups within a single molecule of R may be identical to or different from one another.

$R^1$ is a divalent hydrocarbon group. Concrete examples of such groups include alkylene groups, e.g. methylene, n-propylene, n-butylene, isobutylene, isopropylene, etc.; arylene groups, e.g. phenylene, etc.; and alkylenearylene groups, e.g. ethylenephenylene, etc. Of the aforementioned groups, the alkylene groups are especially desirable. A is a number of 0-10.

The values of p and q are 0 or 1 or above. The value of p+q is 10-2,000. If p+q is lower than 10, it is difficult to effectively improve the flexibility and flatness of the fiber material. If p+q exceeds 2,000, on the other hand, the emulsification efficiency deteriorates.

A is a group selected from among groups corresponding to R, hydroxyl group, alkoxy groups containing 1-3 carbon atoms, and groups represented by $-R^1(NHCH_2CH_2)_aNH_2$. As alkoxy groups containing 1-3 carbon atoms, a methoxy group, ethoxy group, isopropoxy group, and n-propoxy group can be used. If both groups corresponding to A are groups represented by $-R^1(NHCH_2CH_2)_aNH_2$, the value of q may be 0.

The diorganopolysiloxane segment of the structure constituting component (A) enhances the flexibility and flatness, and the amino group segment forms a salt or amide bond with component (B).

Component (B) is a compound represented by the general formula $R^2(C_2H_4O)_bR^3COOH$. Component (B) forms a salt with the amino group of component (A), or an amide bond may be formed depending on heating conditions. As a result, the yellowing resistance, water absorbency, and perspiration absorbency of a treated textile are improved. Moreover, the wash resistance improves. The present component also enhances the stability of an emulsion which has been obtained by emulsifying the present composition.

In the aforementioned formula, $R^2$ is a group selected from among alkoxy groups containing 1-3 carbon atoms and groups represented by $—OR^3COOH$.

Concrete examples of alkoxy groups containing 1-3 carbon atoms include a methoxy group, ethoxy group, isopropoxy group, and n-propoxy group. If an alkoxy group containing 4 or more carbon atoms is used, the hydrophobicity increases. Thus, the water absorbency and perspiration absorbency deteriorate. b is a number of 1 or above, preferably 5-25. If said oxyethylene unit is present, the water absorbency, perspiration absorbency, and antistatic properties are improved. $R^3$ is a divalent hydrocarbon group. As such, alkylene groups, e.g. methylene, ethylene, propylene, isobutylene, etc.; and alkylenearylene groups, e.g. $—C_2H_4C_6H_4—$, etc. can be used. In particular, alkylene groups are especially desirable, and the methylene group is ideal.

When the present component is manufactured, both terminal hydroxyl groups of polyethylene glycol are carboxylated using monochloroacetic acid, etc. in a dehydrochlorination reaction, to produce a polyethylene glycol derivative in which both terminals have been carboxylated. In an alternative format, ethylene oxide is addition-reacted with an alcohol, e.g. methanol, ethanol, etc. Then, the resulting addition reaction product is carboxylated using monochloroacetic acid, etc. in a dehydrochlorination reaction to produce a polyethylene glycol derivative in which one terminal has been carboxylated.

It is necessary that the quantity of the present component (B) be 0.05 5.0 mol with respect to 1 mol of the primary and secondary amino groups of component (A). If the quantity added is less than 0.2 mol, it is impossible to improve the yellowing resistance, water absorbency, perspiration absorbency, and antistatic properties. If the quantity added exceeds 5 mol, the tactile properties deteriorate.

The composition of the present invention can be manufactured by uniformly mixing components (A) and (B). Especially desirable results are obtained if said components are heated and mixed at 40°-180° C.

The composition of the present invention may be directly adhered to a fiber material, or it may be used for a fiber treatment process after it has been dissolved in an organic solvent such as, e.g., toluene, xylene, benzene, hexane, heptane, acetone, methyl ethyl ketone, methyl isobutyl ketone, ethyl acetate, butyl acetate, mineral terpene, perchloroethylene, trichloroethylene, etc. Said composition, furthermore, may also be emulsified using a cationic or nonionic surfactant.

Concrete examples of cationic surfactants include octyltrimethylammonium hydroxide, dodecyltrimethylammonium hydroxide, hexadecyltrimethylammonium hydroxide, octyldimethylbenzylammonium hydroxide, decyldimethylbenzylammonium hydroxide, didodecyldimethylammonium hydroxide, dioctadecyldimethylammonium hydroxide, beef trimethylammonium hydroxide, coconut oil trimethylammonium hydroxide, other quaternary ammonium hydroxides, and their salts.

Concrete examples of nonionic surfactants include polyoxyalkylene alkyl ether, polyoxyalkylene alkylphenol ether, polyoxyalkylene alkyl ester, polyoxyalkylene sorbitan alkyl ester, polyethylene glycol, polypropylene glycol, diethylene glycol, etc.

It is desirable that the quantity of the surfactant with respect to 100 parts by weight of the organopolysiloxane used as component (A) be 5-50 parts by weight, preferably 10-30 parts by weight.

There are no special restrictions on the quantity of water, but especially desirable results are obtained if the organopolysiloxane concentration is 5-60 wt %, preferably 10-40 wt %.

When the composition of the present invention is emulsified, the aforementioned surfactant and a small quantity of water are added to a mixture consisting of the aforementioned components (A) and (B), and after the contents have been uniformly mixed, the resulting mixture is emulsified in an appropriate emulsifying apparatus, such as, e.g., an homogenizer, a colloid mill, a line mixer, a propeller mixer, a vacuum emulsifier, etc.

It is also possible to add various conventionally known additives such as, e.g., antistatic agents, softness enhancers, wrinkle inhibitors, heat resistance enhancers, flame retardants, silane coupling agents (which contain amino groups, epoxy groups, etc.), etc. as long as they exert no adverse effects on the objectives of the present invention.

When a fiber material is treated with the present composition, the spray-coating, roll-coating, brush-coating, or dip-coating method can be used. The optimum quantity of adhesion depends on the types of fiber materials, but generally speaking, it is desirable that the quantity of the organopolysiloxane which has been adhered to the fiber material be 0.01-10.0 wt %. Subsequently, the resulting fiber material is left unattended at normal temperature, dried with hot air, or heat-treated. Concrete examples of the fiber constituent materials include natural fibers, e.g. cotton, hemp, silk, wool, angora, mohair, etc.; regenerated fibers, e.g. rayon, Bemberg, etc.; semisynthetic fibers, e.g. acetate, etc.; synthetic fibers, e.g. polyester, polyamide, polyacrylonitrile, polyvinyl chloride, vinylon, polyethylene, polypropylene, Spandex, etc.; and inorganic fibers, e.g. glass fiber, carbon fiber, silicon carbide fiber, etc. Concrete examples of the shapes of fibers include staples, filaments, tows, tops, and yarns. These fibers can be processed into knitted fabrics, woven fabrics, or nonwoven fabrics.

In the paragraphs to follow, the contents of the present invention will be explained in further detail with reference to application examples, but not limited thereby. In subsequent application examples, the expressions "parts" and "%" refer to "parts by weight" and "wt %," respectively. The viscosity was measured at 25° C. Me denotes methyl.

APPLICATION EXAMPLE 1

Treatment baths (a)-(f) were prepared using an amino group-containing organopolysiloxane with a viscosity of 1,100 cst (centistokes) represented by the formula $$Me_3SiO(Me_2SiO)_{400}(\underset{\underset{(CH_2)_3NH(CH_2)_2NH_2}{|}}{MeSiO})_8SiMe_3$$

and designated Siloxane A; Compound B, which is represented by formula $CH_3O(C_2H_4O)_7CH_2COOH$ (number-average molecular weight=400), and toluene according to the composition shown in Table I.

TABLE I

| Components | Composition (parts) Invention (a) | (b) | (c) | (d) | Comparison (e) | (f) |
|---|---|---|---|---|---|---|
| Siloxane A | 9.2 | 9.2 | 9.2 | 9.2 | 9.2 | 0 |
| Compound B | 6.3 | 2.1 | 1.0 | 0.2 | 0 | 0 |
| Toluene | 985.5 | 988.7 | 989.8 | 990.6 | 990.8 | 1000 |
| Mol Ratio* | 3 | 1 | 0.5 | 0.1 | 0 | — |

*Mols of Compound B per mols of primary and secondary amino groups.

After a 100% cotton broadcloth fabric (dimensions: 50 cm×50 cm) which had undergone a fluorescent whiteness-enhancing treatment had been immersed in each of the resulting treatment baths for 10 sec, it was drawn up, and after it had been squeezed using squeezing rollers at a squeezing efficiency of 100%, it was spread and dried at room temperature (quantity of adhered siloxane A: 0.9%). After said fabric had been heat-treated in a 150° C. hot-air drier for 5 min, it was retrieved.

After the resulting broadcloth fabric had been cut into two at the middle, the yellowness index (YI) as a result of said heat treatment was measured using color computer SM (manufactured by Suga Kikai Co.). The rigidity/softness index (i.e., flexibility parameter) was measured by the Clark method, and the wrinkle resistance was measured by the Monsanto method (both of the aforementioned factors were measured only in the longitudinal direction of the fabric). The overall grade as a men's dress-shirt fabric was evaluated according to the following criteria (the results are shown in Table II): E: excellent touch (i.e., rigidity/softness index), no yellowish coloration, and excellent wrinkle resistance (ideal treatment agent for a men's dress-shirt fabric); Q: somewhat questionable overall performances; U: unacceptable as a men's dress shirt fabric treatment agent in terms of overall performances (i.e., significant yellowish coloration and too sleazy).

As the results of Table II clearly indicate, the treatment agent of the present invention was unaccompanied by yellowish coloration, and excellent flexibility and wrinkle resistance were attained. Thus, said agent was ideal for treating a men's dress-shirt fabric.

TABLE II

| Composition | Fabric Properties: Yellowness Index YI | Rigidity/Softness Index (mm) | Wrinkle Resistance (%) | Overall Grade |
|---|---|---|---|---|
| (a) | 1.39 | 35 | 79 | E |
| (b) | 1.38 | 35 | 81 | E |
| (c) | 1.39 | 36 | 80 | E |
| (d) | 1.42 | 35 | 80 | E |
| (e) | 8.01 | 37 | 78 | U |
| (f) | — | 47 | 70 | U |

APPLICATION EXAMPLE 2

After 10 parts of an amino group-containing organopolysiloxane with a viscosity of 1,200 represented by the following formula:

$$Me_3SiO(Me_2SiO)_{400}(\underset{\underset{(CH_2)_3NH(CH_2)_2NH_2}{|}}{MeSiO})_{16}SiMe_3$$

and designated Siloxane B; 2.6 parts of a compound represented by formula $HOOCH_2O(C_2H_4O)_{23}CH_2COOH$ (number-average molecular weight: 1,000), and 987.4 parts of toluene had been sufficiently mixed, treatment bath (g) was obtained. After a 30 cm×60 cm 100% cotton plain fabric had been immersed in the resulting bath for 30 sec, it was squeezed using mangle rollers at a squeezing efficiency of 100%. Then, it was dried at room temperature (quantity of adhered organopolysiloxane: approximately 1.0%).

For comparative purposes, an identical plain fabric was treated in the following treatment baths (h) and (i). Treatment bath (h) : 10.0 parts of Siloxane B and 2.6 parts of polyethylene glycol represented by formula $HO(C_2H_4O)_{22.3}H$ (molecular weight: approximately 1,000) were dissolved in 987.4 parts of toluene; Treatment bath (i): 10 parts of Siloxane B were dissolved in 990 parts of toluene.

After said plain fabric had been divided into two, one was washed under the following conditions three times. Thus, a repeatedly washed treated fabric was obtained.

Washing treatment procedures: After each fabric had been washed with a 0.3% solution (40° C.) containing Love (commercial laundry detergent manufactured by Nissan Sekken Co.) in a domestic electrical washing machine for 15 min, unused supply water was added, and said fabric was rinsed over a 5-min period three times. The aforementioned series of procedures were defined as one washing cycle.

The treated fabric which had undergone three washing cycles and an unwashed fabric were spread, and after a single water droplet had been dropped onto each fabric, the time elapsed before said water droplet had completely diffused was recorded (i.e., water absorbency test). The feel of the unwashed fabric was subjectively evaluated, and overall evaluations as an underwear treatment agent were rendered. The results are summarized in Table III.

When the treatment agent was used, an excellent lasting water absorbency was sustained during the washing process. The lasting water absorbency of the comparative sample was inferior.

TABLE III

| Bath | Water Absorbancy, (sec) Before Washing | After Washing | Feel Before Washing | Overall Performance |
|---|---|---|---|---|
| (g) | 1.3 | 3.6 | Extremely soft and excellent fit | E |
| (h)* | 1.3 | 600+ | Extremely soft and excellent fit | U |
| (i)* | 600+ | 600+ | Extremely soft and excellent fit | U |
| ** | 0 | 0 | Inferior feel and inferior fit | U |

*Comparison. ** Untreated. + Or greater.

APPLICATION EXAMPLE 3

After 990 parts of an amino group-containing organopolysiloxane with a viscosity of 135 cst represented by the following formula:

$$Me_3SiO(Me_2SiO)_{98}(\underset{\underset{(CH_2)_3NH(CH_2)_2NH_2}{|}}{MeSiO})_2SiMe_3$$

and designated as Siloxane C and 10 parts of a compound represented by formula $CH_3O(C_2H_4O)_7CH_2COOH$ had been placed into a 300-mL four-necked flask, said flask was sealed in nitrogen gas. Then, the contents were heated at 140°–150° C. for 60 min. After the resulting treatment solution had been cooled, 40 parts of said solution were transferred to a 500-mL beaker, and after 8.0 parts of polyoxyethylene (6 mol added) trimethylnonanol ether and 2.0 parts of polyoxyethylene (10 mol) trimethylnonanol ether had been added to the resulting solution, the contents were mixed for 10 min using an agitation mechanism, and after 10.0 parts of water had subsequently been added to the resulting mixture, the contents were agitated for 10 min. After 140 parts of water had subsequently been added to the resulting mixture, the contents were mixed for 30 min. Thus, an emulsion was obtained (treatment solution (j)).

For comparative purposes, an emulsion was prepared using Siloxane C in combination with the aforementioned emulsifiers (i.e., two types of polyoxyethylene trimethylnonanol ether emulsifiers) and water according to otherwise identical procedur es (treatment solution (k)).

After 95 parts of water had been added to 5 parts each of the resulting treatment solutions ((j) and (k)), a treatment bath was obtained. Subsequently, a 100% cotton broadcloth fabric (dimensions: 30 cm×30 cm) which had undergone a fluorescent whiteness-enhancing treatment was immersed in said treatment bath for 10 sec.

After said fabric had been squeezed using mangle rolls at a squeezing efficiency of 100%, it was dried at room temperature. Subsequently, said fabric was heated in a 130° C. oven for 3 min. Subsequently, the feel of the resulting treated fabric was subjectively evaluated. After the treated fabric had been cut into a 5 cm×10 cm test piece, half of the resulting test piece was covered with black paper, and after it had been exposed with a Fade-Ometer light resistance tester for 3 h, the degree of yellowish coloration was evaluated using the fading gray scale specified in JIS L 0804 (grade).

As the results of Table IV clearly indicate, excellent feel is sustained if the treatment agent of the present invention is used, and the yellowish coloration in the presence of light was minimized.

TABLE IV

| Bath | Properties: Touch | Properties: Fade-Ometer |
|---|---|---|
| (j) | Excellent flexibility and elasticity, ideal as a broadcloth treatment agent (moderately sleazy). | 4–5 |
| (k)* | Flexible and elastic, too sleazy. | 2–3 |
| ** | Hard, extremely inferior touch, and inferior resilient elasticity. | 4–5 |

*Comparison. ** Untreated.

APPLICATION EXAMPLE 4

After 936.0 parts of an amino group-containing organopolysiloxane with a viscosity of 1,450 cst represented by the following formula:

$$HO(Me_2SiO)_{400}(\underset{\underset{(CH_2)_3NH(CH_2)_2NH_2}{|}}{MeSiO})_8H$$

and designated Siloxane D had been placed into a 500 mL beaker, 4.0 parts of a compound represented by formula $C_2H_5O(C_2H_4O)_{5.8}CH_2COOH$ were added. Then, the contents were mixed using an agitation mechanism for 10 min. After 8.0 parts of polyoxyethylene (6 mols added) trimethylnonanol ether and 2.0 parts of polyoxyethylene (10 mols added) trimethylnonanol ether had subsequently been added to the resulting mixture, the contents were mixed using an agitation mechanism for 10 min. After 10.0 parts of water had subsequently been added, the contents were agitated for 10 min, and after 140 parts of water had subsequently been added, the contents were mixed for 30 min. Thus, an emulsion was obtained (treatment solution (1)).

For comparative purposes, an emulsion was prepared using amino group-containing Siloxane D in combination with the aforementioned emulsifiers (i.e., two types of polyoxyethylene trimethylnonanol ether emulsifiers) and water according to otherwise identical procedures (treatment solution (m)).

After 95 parts of water had been added to 5 parts each of the resulting treatment solutions, a treatment bath was obtained. After a 100% cotton broadcloth identical to that used in Application Example 1 had been treated in said treatment bath, the yellowness index (YI) was measured, and the overall performances as a men's dress-shirt fabric were evaluated. The results are summarized in Table V.

When the treatment agent of the present invention was used, there was no yellowish coloration, and it was ideal as a men's dress-shirt fabric treatment agent.

TABLE V

| Treatment Solution | Properties: Yellowness Index, (YI) | Properties: Overall Performance |
|---|---|---|
| (1) | 1.20 | E |
| (m)* | 6.37 | U |
| ** | — | U |

*Comparison. **Untreated.

EFFECTS OF THE INVENTION

If the concept of the present invention is actualized, a fiber treatment agent composition which is capable of enhancing the water absorbency, perspiration absorbency, flexibility, lubricancy, and resilient elasticity of a fiber material can be obtained without inducing the yellowish coloration of said fiber material.

The fiber treatment agent composition of the present invention, furthermore, can be easily emulsified, and the stability of the resulting emulsion is excellent as well.

That which is claimed is:

1. A fiber treatment agent composition comprising (A) an organopolysiloxane which is represented by the formula $$Ar_2SiO(R_2SiO)_p(\underset{\underset{R^1(NHCH_2CH_2)_aNH_2}{|}}{RSiO})_qSiR_2A$$

in which R is a monovalent hydrocarbon group; A is a group selected from the group consisting of R groups, the hydroxyl group, alkoxy groups containing 1–3 carbon atoms, and groups represented by $-R^1(NHCH_2CH_2)_aNH_2$; $R^1$ is a divalent hydrocarbon group; the subscript a is a number of 0 to 10; the subscripts p and q are 0 or numbers of 1 or above; p+q has a value of from 10 to 2,000 there being at least one intramolecular group represented by the following formula $-R^1(NHCH_2CH_2)_aNH_2$; and (B) a compound represented by the formula $R^2(C_2H_4O)_bR^3COOH$ in which $R^2$ is a group selected from the group consisting of alkoxy groups containing 1–3 carbon atoms and groups represented by —$OR^3COOH$; the subscript b is a number of 1 or above; $R^3$ is a divalent hydrocarbon group; the amount of (B) being from 0.05 to 5.0 mol with respect to 1 mol of primary and secondary amino groups of component (A).

2. A fiber treatment agent composition according to claim 1 wherein all R groups are methyl groups.

3. A fiber treatment agent composition according to claim 2 wherein all $R^3$ groups are methylene groups.

4. A fiber treatment agent composition according to claim 1 further comprising an organic solvent for the composition.

5. A fiber treatment agent composition according to claim 1 further comprising water and one or more surfactants in sufficient amount to emulsify the composition in the water.

6. A fiber treatment agent composition according to claim 1 wherein both A groups are R groups.

7. A fiber treatment agent composition according to claim 1 wherein both A groups are hydroxyl groups.

8. A fiber treatment agent composition according to claim 1 wherein the subscript a has a value of 1 and all $R^1$ groups are alkylene groups.

9. A fiber treatment agent composition according to claim 1 wherein $R^2$ denotes an alkoxy group.

10. A fiber treatment agent composition according to claim 1 wherein $R^2$ denotes an —$OR^3COOH$ group.

* * * * *